United States Patent [19]

Gamm

[11] Patent Number: 4,612,714

[45] Date of Patent: Sep. 23, 1986

[54] ATHLETIC SHOE POCKET WITH REAR FLAP

[75] Inventor: Robert J. Gamm, St. Louis, Mo.

[73] Assignee: Kangaroos U.S.A., Inc., Maryland Heights, Mo.

[21] Appl. No.: 757,917

[22] Filed: Jul. 22, 1985

Related U.S. Application Data

[63] Continuation of Ser. No. 433,460, Oct. 8, 1982, abandoned, which is a continuation-in-part of Ser. No. 314,134, Oct. 23, 1981, abandoned.

[51] Int. Cl.[4] ..... A43B 23/00

[52] U.S. Cl. ..... 36/136; 36/114

[58] Field of Search ..... 36/136, 132, 114, 129; 2/DIG. 6; D2/309, 310

[56] References Cited

U.S. PATENT DOCUMENTS

| | | | |
|---|---|---|---|
| 2,712,700 | 7/1955 | Solomon | 36/136 X |
| 2,801,477 | 8/1957 | Adams et al. . | |
| 3,018,570 | 1/1962 | Bliese | 36/136 X |
| 4,280,287 | 7/1981 | Gulbransen | 36/136 |
| 4,296,559 | 10/1981 | Gamm | 36/136 |
| 4,372,060 | 2/1983 | Adamik | 36/136 X |

*Primary Examiner*—James Kee Chi

*Attorney, Agent, or Firm*—Paul M. Denk

[57] ABSTRACT

In an athletic shoe forming a pocket at its quarter portion, the pocket comprises a liner of material, or a pair of the same, each stitched or otherwise fastened to the side or quarter portion of the shoe, and integrally constructed therein, so that the various edges of the pocket are confiningly affixed to the shoe, while the bottom edge of the pocket may be stitched to the quarter panel upwardly of the sole, or may be secured with the shoe through the effort of the stitching or adhesive that holds the quarter portion to the sole shank. Proximate the rearward edge of the pocket, or perhaps forwardly thereof, as in various embodiments, there is provided a slot opening, which may be securable through the connection of a zipper, or other closure means, so that access may be attained into the pocket for admitting personal items therein. A covering flap attaches just forwardly of the slot opening, at the location of its zipper or another closure means, and extends rearwardly for overlying the emplaced zipper, and adhering against the formed pocket rearwardly thereof, or perhaps that quarter portion of the shoe located rearwardly thereof, so as to provide overlying coverage of this operative portion of the pocket slot.

6 Claims, 3 Drawing Figures

ATHLETIC SHOE POCKET WITH REAR FLAP

CROSS-REFERENCE TO RELATED APPLICATIONS

This application is a continuation of the application having Ser. No. 433,460, filed on Oct. 8, 1982 now abandoned; which identified application is a continuation-in-part of the application for Letters Patent having Ser. No. 314,134, filed on Oct. 23, 1981, and which has been abandoned in favor of a continuation application having Ser. No. 612,992, filed on May 21, 1984, and which latter application has been abandoned in favor of the continuation application having Ser. No. 802,935, filed on Nov. 27, 1985, all of which applications are owned by a common assignee.

BACKGROUND OF THE INVENTION

This invention relates generally to athletic shoes, and more particularly pertains to a formed pocket arranged laterally of the shoe and having utility for temporary storage of personal items during shoe usage, and including a covering flap that is arranged extending rearwardly to provide overlying coverage for the slot opening for the shoe pocket, in addition to the closure means for the said slot.

A variety of prior art patents have given consideration to the construction of a pocket into the fabrication of the shoe, but when one examines these prior inventions, almost universally, the pockets are simply a stitched on layer of material to form a rather surface arranged pocket, in most instances containing no closure means, and more specifically are provided essentially upon what may be more aptly described as ornamentation for dress shoes. For example, such are clearly shown in the earlier patents to Bliese, No. U.S. Pat. No. 3,018,570, the Adams, U.S. Pat. No. 2,801,477, the French patent No. 1,447,044, to S. A. R. L. Chupin-Maugienne, in addition to the prior British patent No. 302,862, to Chievers.

More contemporary inventors have given thought to various types of structures forming pocket means within shoes and boots, such as shown in the Corlay, U.S. Pat. No. 2,908,982. The concept of adding decorativeness to the shoes through the addition of a purse, or the like, as by attaching the same upon the frontal shoe upper, or its vamp, is shown in the earlier United States patent to Bliese, as aforesaid, in addition to the Solomon, U.S. Pat. No. 2,712,700. Furthermore, the adding of holding means having some utility to the shoe, as by securing the same through its laces to the shoe, is shown in the golf tee holder as devised by Perry, in his U.S. Pat. No. 2,662,677.

The safety of the personal items was given consideration in the early Diemer, U.S. Pat. No. 654,388, upon a shoe, and discloses a means for securing valuables concealingly within the calf portion of the shoe, and more specifically upon its internal portion that rests against the leg. Various other forms of similar type of pocket structures used in association particularly with boots are also shown in the earlier Wirsching, U.S. Pat. No. 1,289,341, McAuslin, U.S. Pat. No. 1,100,758, in addition to the patent to Avis, U.S. Pat. No. 1,342,149.

All of the foregoing embodiments have some utility for holding some component or personal item, such as money, in generally a concealed fashion upon the wearer, while the current invention, to the contrary, intends to provide a pocket part that is built structurally into and comprises a component part of the liner material forming the quarter part or portion of the shoe, arranging its closure means at a position generally angularly along the formed pocket, usually proximate its rearwardly disposed edge, and then arranging a covering flap for providing closure for the formed pocket slot, in addition to whatever closure means, such as a zipper, that is used for providing pocket securement.

Another object of this invention is to provide a pocket means that is integrally structured into the quarter portion of the athletic shoe, within the liner materials forming its structure, and incorporating a rearwardly oriented covering flap that assures retention of personal items within the formed pocket, while simultaneously enhancing the attractiveness of the fabricated shoe.

Still another object of this invention is to provide an athletic shoe having a pocket formed upon its quarter portion, and incorporating an aesthetically attractive covering flap capable of holding indicia appended to the pocket and oriented rearwardly thereof so as to provide the appearance of a continuation of the formed pocket within the shoe structure.

Still another object of this invention is to provide the arrangement of a formed pocket within the quarter portion of an athletic shoe, with the covering flap concealing the closure means for the pocket in a manner that renders the pocket unnoticeable to the viewer even though it is structured directly into the quarter portion of the fabricated shoe.

Still another object of this invention is to provide a shoe pocket having an opening slot which is arranged angulated, or perhaps vertically, upon the formed pocket and having a covering flap thereover so as to provide securement of personal items therein, but facilitates their convenient removal through an opening pivot made of the flap for disclosure of the pocket slot and its closure means.

Another object of this invention is to provide a shoe pocket integrally formed into the structure of the shoe, and having a rearwardly oriented closure flap that can be conviently and promptly installed during a stage of shoe assembly.

These and other objects wil become more apparent to those skilled in the art upon reviewing the summary of this invention, and upon undertaking a study of the description of its preferred embodiment, in view of the drawings.

SUMMARY OF INVENTION

This invention relates to the formation of an athletic shoe, and more specifically one having a pocket part or portion structured into the shoe side or quarter location, with the structure generally being formed through the addition of layers of material at the quarter portion, being stictched thereto along particular edges, for the purpose of forming a pocket thereat. The material is usually stitched along the front edge, proximate the eye stay, along the back edge, with its lower portion either being stichted into the integral structure of the shoe quarter, or perhaps held thereat by means of adhesive useful for forming the connection between the shoe upper with its sole. In this particular invention, with the pocket part being integrally constructed into the formation of the shoe quarter, along the approximate back edge of the formed pocket, there is located a slot, and which slot is useful for providing quick access into the interior of the formed pocket. But, such slot may also be located further forwardly of the pocket, and function just as appropriately to provide an entrance into the pocket part, for this invention. In addition, closure means may be provided at this location, generally undertaking the configuration of a zipper, with the pocket part then having a fold over flap, generally at least sufficent to cover the length of the upper to lower angularly arranged zipper means, within this formed slot, in addition to having sufficent width so as to provide for a full overlying of the formed closure means. The closure flap is designed to provide the appearance of providing a continuation of the formed pocket and by overlying the closure means for the pocket, provides the pocket with an overall appearance as comprising an integral part of the shoe quarter portion, without really revealing that a pocket part is located thereat.

In addition to the foregoing, the fold over flap, which does fold rearwardly of the formed pocket, may be held by velcro to the shoe quarter, or the rear edge of the formed pocket, and into contiguity with the shoe structure, so as to provide for its more permanent retention thereat, particularly during shoe usage, so as to avoid any flapping or waving of the overlying flap during foot pronation and pivot during usage of the formed shoe for a gymnastic, athletic, or other activity. In addition to the foregoing, since the overlying covering flap is arranged along the curved portion for the quarter part of the shoe in its construction, as it rests upon the foot, after application, the natural curvature of the shoe at this location, from its sole extending up to its eye stay, has a tendency to assure that the covering rearward extending flap maintains contiguity with the underlying shoe, or its pocket, due to this naturally formed curvature in the shoe construction.

BRIEF DESCRIPTION OF THE DRAWINGS

In the drawings, FIG. 1 provides a side view of a shoe with pocket and having its rearward flap, all formed upon the quarter portion of an athletic shoe.

DESCRIPTION OF PREFERRED EMBODIMENT

Figure 1:
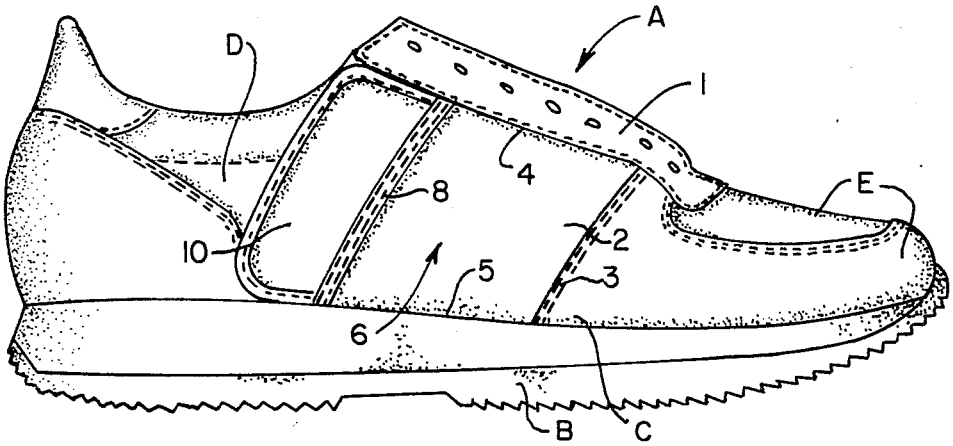
Figure 2:
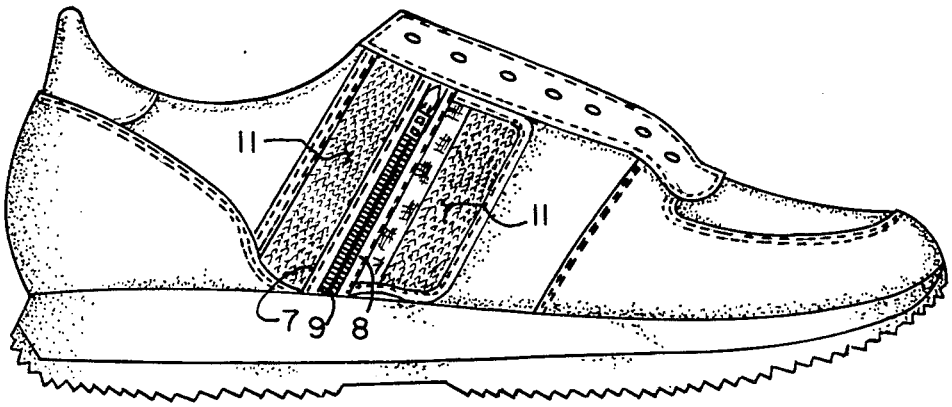
FIG. 2 provides a view of the athletic shoe of FIG. 1, further disclosing the rearwardly extending flap being folded forwardly, so as to disclose the zipper closure means for the pocket slot, in addition to the fastening means, such as velcro, useful for holding the flap in position during shoe usage.
Figure 3:
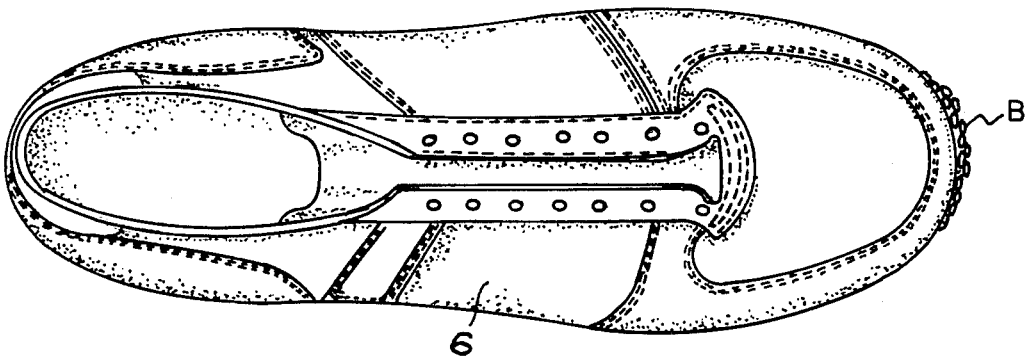
FIG. 3 provides a top view of the athletic shoe with rear flap as shown in FIG. 1.

In referring to the drawings, and in particular the FIGS. 1 through 3, there is shown in both the side, top and flap open views the athletic shoe A which is of the usual construction having a sole portion B stitched or otherwise adhered to its shank C and to the shoe quarter D, in addition to the upper and lower vamp portions E, of the shoe upper as normally constructed into the assembled shoe. In addition, an eye stay 1 is also stitched to the shoe quarter, at its upper margin, and useful for securing the usual laces that hold the shoe in placed shoe upon the foot. In this particular embodiment, a liner of material, as at 2, and also comprising therein a singular or pair of liners, is also stitched along its reinforced front edge, as at 3, and additionally to through its seams 4, and perhaps 5, functioning to form a pocket part, as at 6, integrally constructed into the configuration of the shoe quarter portion. In addition, stitching may be provided along the rear edge of the liner material, as at 7, for providing closure to the back edge of the formed pocket. In order to facilitate the usage of the formed pocket associated with the identified shoe, it is desirable that the pocket have sufficient extention from approximately its eye stay 1 into the region of the shoe shank, in addition to extending from that position located near the frontal edge of the shoe quarter portion, as at 3, and near where creasing occurs, back to its edge 7, in order that the pocket may have sufficent depth and length in order to accommodate the type of personal items as previously identified.

With the attachment of the pocket linings to the shoe quarter, or at its sides, and with either a single or doubling lining being employed, the shoe pocket is thus formed and secures into the side portion of the shoe. The outer lining may form the outer surface of the formed pocket, while the inner lining for the shoe quarter may form the interior or inner surface for the formed pocket. In any event, said liners being integrally construction into the shoe quarter portion thus form that particular portion for the shoe structure, in addition to whatever additional liner material may be used interiorly thereof and which extends into contact with the surface of the foot.

Provided proximate the back edge 7 of the formed pocket, or perhaps even forwardly thereof, more so than that shown, is provided a slot, as at 8, and which is arranged substantially from the upper to the lower edge of the formed pocket, for the purpose of providing access into the formed shoe pocket, as desired. Provided, preferably, at the region of the formed slot for the pocket, there is furnished a closure means, such as the shown zipper 9, and such zipper is provided through the outer most pocket lining, and forms the closure for the slot formed along the height of the arranged pocket, for the purpose of assuring containment of the personal items within the pocket, when required. In those instances where the pocket is formed of a single liner of material, the items would then be located between the said liner, forming the outer covering for the pocket, and the side of the constructed shoe. But, in those other instances where the shoe pocket is formed from a pair of linings, the space between the linings formed the desired pocket. This has already been fully identified and explained in my previous patent applications. By simply manipulating a zipper from the top to the bottom, or vice versa, for providing for its opening, personal items such as keys or coins may be inserted within the pocket for safekeeping as during participation within an athletic event, such as while one is jogging and running. The pocket, in this formation, is adequate for providing safekeeping for such items, but the usual jogging paraphernalia, such as shorts, or a sweat shirt, which ordinarily do not contain pockets, and if they do, are likely to lead to a loss of coin or keys that may be kept within the same, particularly during the strenuous exercise encountered as during jogging.

To further add to the structure of the shown invention, a flap 10 may secure along the proximate front edge of the formed pocket slot, as shown in FIG. 2, being stitched to the outer surface of the formed pocket itself, and which flap may be conveniently folded over, in a rearward direction, into contiguity against and overlying the formed pocket slot, and adhered against either the disposed formed pocket located rearwardly thereof, or perhaps overlying against the shoe quarter, by means of any fastening means such as the Velcro 11, as shown. Such a flap does add to the safekeeping of the pocketed items, and in those instances where a closure means such as a zipper may not be used, assures the safety of retention of the personal items within the pocket. In addition, such a covering flap does add to the overall attactiveness of the shoe, blending with the formed pocket located forwardly thereof, and generally giving the appearance of a continuation in the extension of the shoe quarter portion rearwardly, towards the shoe counter, as being simply a part of the formed quarter, and generally diminishing the appearance of any pocket even being located upon the shoe quarter in the first instance. Obviously, in place of the velcro, 11, as shown, any type of a snap or clasp fastener, as known in the art, can be used for holding the rearwardly extending flap in place against the shoe quarter, or its pocket, so as to maintain its position as shown in FIG. 1. But, as previously explained, the natural curvature of the shoe along the location of the stitching 8, which extends angularly upwardly along the shoe quarter, has a tendency to assure the contiguity of the formed flap against the shoe quarter, at that location, since there is a natural tendency for curvature of the shoe, and its overlying flap, at this location to have inherent pressure that urges the flap into a tight overlying relationship against the shoe quarter, and to prevent its looseness or flapping outwardly as during shoe usage.

Variations or modifications in the shoe design, or more specifically for the formed pocket provided within the construction of this athletic shoe, may occur to those skilled in the art upon reviewing the subject matter of this invention. Velcro, as is known, in the art, is a hook and pile type of fastener. For example, the pocket slot, and/or its closure means may be located more forwardly of the formed pocket, having its overlying flap yet stitched or otherwise adhered just proximate its front edge, and lying rearwardly to provide overlying coverage upon the same. Any such changes, if within the spirit of this invention, are intended to be encompassed within the scope of any claims to patent protection issuing upon this invention. The various definitions of this invention previously set forth herein are done so for illustrative purposes only.

Having thus described the invention, what is claimed and desired to be secured by Letters Patent is:

1. In a pocket for an athletic shoe and designed to hold smaller size personal items such as keys, coins, or the like, comprising, such shoe having a quarter portion extending from its eyestay and securing approximate the sole shank at its lower extent, a pocket stitched to the shoe quarter along particular of its edges, there being a slot provided within said pocket to allow access to its interior for the deposit of the aforesaid type of items therein, said slot being arranged extending approximately from the upper to the lower edges of said pocket, a cover flap, said cover flap along one edge being stitched to the pocket approximately along the frontal edge of the formed pocket slot, and extending approximately from the eyestay to the sole shank, said cover flap disposed for also extending rearwardly and capable of folding over into contiguity overlying part of the formed shoe and pocket and providing at least its slot with coverage, said cover flap overlying a part of the formed pocket and shoe, the curvature of the shoe at the location of said cover flap pressuring said flap into a tight contiguity with the underlying shoe and pocket thereat, said pocket being integrated into the quarter portion of the shoe and also extending from the eyestay to the sole shank, said pocket being formed having a back edge thereof, and said pocket slot being disposed in proximity and in alignment with the said disposed bakc edge of the said pocket, zipper means provided upon the shoe within the region of and upon the opening of its formed pocket slot, whereby upon opening of said zipper means the identified type of items may be inserted within the pocket for safe keeping, said zipper means being arranged aligned approximately and in the vicinity with the back edges of the formed pocket, and fastening means provided upon both the cover flap and one of said shoe quarter and formed pocket and cooperating to hold the said cover flap against the said shoe during usage, and said cover flap capable of folding forwardly for exposing the zipper means and pocket slot for the insertion or removal of the identified items from within the formed pocket.

2. The invention of claim 1 and wherein said fastening means comprises a hook and pile fastener.

3. The invention of claim 1 and wherein said fastening means comprises a snap clasp fastener.

4. The invention of claim 1 and wherein said pocket is formed of a singular layer of cloth material.

5. The invention of claim 1 and wherein said pocket comprises a series of layers of cloth material, the inner layer of said pocket lying contiguous against the shoe quarter, and functioning as the inner portion of the formed pocket, the other layer acting as an outer portion for the pocket and having the fastening means affixed thereto.

6. The invention of claim 1 and wherein said zipper means being arranged angulated upon the pocket and extending approximately from its upper to its lower edges thereof, with said cover flap folding over into contiguity overlying upon at least one of said formed pocket and shoe quarter portion to provide coverage overlying the zipper means.

* * * * *